US006595877B2

(12) United States Patent
Pearson

(10) Patent No.: US 6,595,877 B2
(45) Date of Patent: Jul. 22, 2003

(54) BASKETBALL RETURN NET ASSEMBLY WITH ADJUSTMENT BRACKET

(75) Inventor: Malcolm Pearson, Grimsby (CA)

(73) Assignee: Dicon Rose Inc., Grimsby (CA)

( * ) Notice: Subject to any disclaimer, the term of this patent is extended or adjusted under 35 U.S.C. 154(b) by 0 days.

(21) Appl. No.: 09/929,042

(22) Filed: Aug. 15, 2001

(65) Prior Publication Data

US 2002/0025865 A1 Feb. 28, 2002

Related U.S. Application Data

(60) Provisional application No. 60/224,803, filed on Aug. 18, 2000.

(51) Int. Cl.[7] ..... A63B 69/00

(52) U.S. Cl. ..... 473/433; 473/431; 473/432; 473/447

(58) Field of Search ..... 473/433, 431–435, 473/415, 422, 197, 492–494, 103, 116, 119; 273/396, 397, 317.3, 404, 410

(56) References Cited

U.S. PATENT DOCUMENTS 3,195,898 A * 7/1965 Respini ..... 473/454
3,901,506 A * 8/1975 Caveney ..... 473/433
4,693,472 A * 9/1987 Newman et al. ..... 473/435
4,880,239 A * 11/1989 Leneveu ..... 473/192
5,129,648 A * 7/1992 Sweeney et al. ..... 473/433
5,183,253 A * 2/1993 Grimaldi et al. ..... 273/397
5,374,054 A * 12/1994 Suess ..... 473/433
5,785,616 A * 7/1998 Dodge ..... 473/479
5,971,873 A * 10/1999 Balducci ..... 473/433
6,074,313 A * 6/2000 Pearson ..... 473/447

* cited by examiner

*Primary Examiner*—Paul T. Sewell
*Assistant Examiner*—Mitra Aryanpour
(74) *Attorney, Agent, or Firm*—Robert F. Delbridge

(57) ABSTRACT

A basketball return net assembly is attachable to a basketball hoop support having a post extending upwardly from the ground and carrying a basketball hoop adjacent an upper end thereof. The return net assembly includes a flexible foldable return net and an elongated rigid net-carrying member extending along the upper end of the net to enable the net to be supported in a latterly-extending configuration. The upper end of the net and the net-carrying member can be suspended from an upper portion of the hoop support behind the hoop, and an attachment bracket is connected to opposite lower corner portions of the net and is adjustably securable to the post to enable the bracket to be adjusted relative thereto.

12 Claims, 4 Drawing Sheets

BASKETBALL RETURN NET ASSEMBLY WITH ADJUSTMENT BRACKET

RELATED APPLICATION

This application claims priority from U.S. Provisional Patent Application Serial No. 60/224,803 filed Aug. 18, 2000.

FIELD OF INVENTION

This application relates to basketball return net assemblies which are attachable to basketball hoop supports for returning basketballs to a thrower.

BACKGROUND OF INVENTION

Various such return net assemblies are known, for example as described in U.S. Pat. No. 6,074,313 (Pearson) issued Jun. 13, 2000. However, there is still a need for a return net assembly which is more adjustable.

It is therefore an object of the invention to provide a basketball return net assembly which is more adjustable than known return net assemblies.

SUMMARY OF INVENTION

The present invention provides a basketball return net assembly attachable to a basketball hoop support having a post extending upwardly from the ground and carrying a basketball hoop adjacent an upper end thereof. The return net assembly includes a flexible foldable return net, an elongated rigid net-carrying member extending along the upper end of the net to enable the net to be supported in a laterally-extended configuration, and suspension means for suspending the upper end of the net and the net-carrying member from an upper portion of the hoop support behind the hoop. The net assembly also includes an attachment bracket connected to opposite lower corner portions of the net and adjustably securable to the post to enable the bracket to be adjusted relative thereto.

The attachment bracket may be adjustable vertically and/or angularly about the longitudinal axis of the post and/or about an axis transverse to the longitudinal axis of the post.

The attachment bracket may have a transversely extending frame member and a pair of net positioning arms extending forwardly from respective opposite ends of the transversely extending frame member, the net having opposite lower corner portions secured to respective forward ends of the net positioning arms.

The attachment bracket may include a pair of laterally spaced mounting rods extending past the post on opposite sides thereof and adjustably slidably mounted in a mounting bracket mounted on the post. The mounting bracket may be vertically and angularly adjustable relative to the post.

DESCRIPTION OF THE DRAWINGS

One embodiment of the invention will now be described, by way of example, with reference to the accompanying drawings, which.

DESCRIPTION OF PREFERRED EMBODIMENTS

Figure 3A:
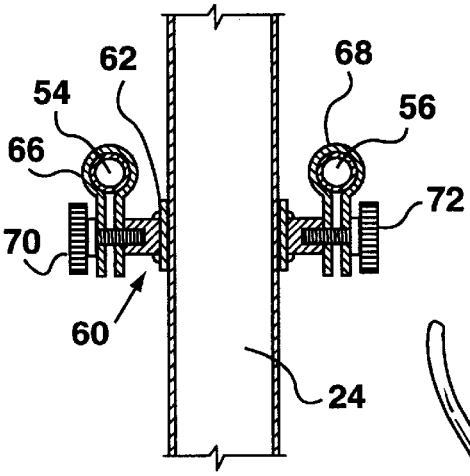
FIG. 3*a* is a sectional view taken along the line 3*a*—3*a* of FIG. 3.
Figure 3:
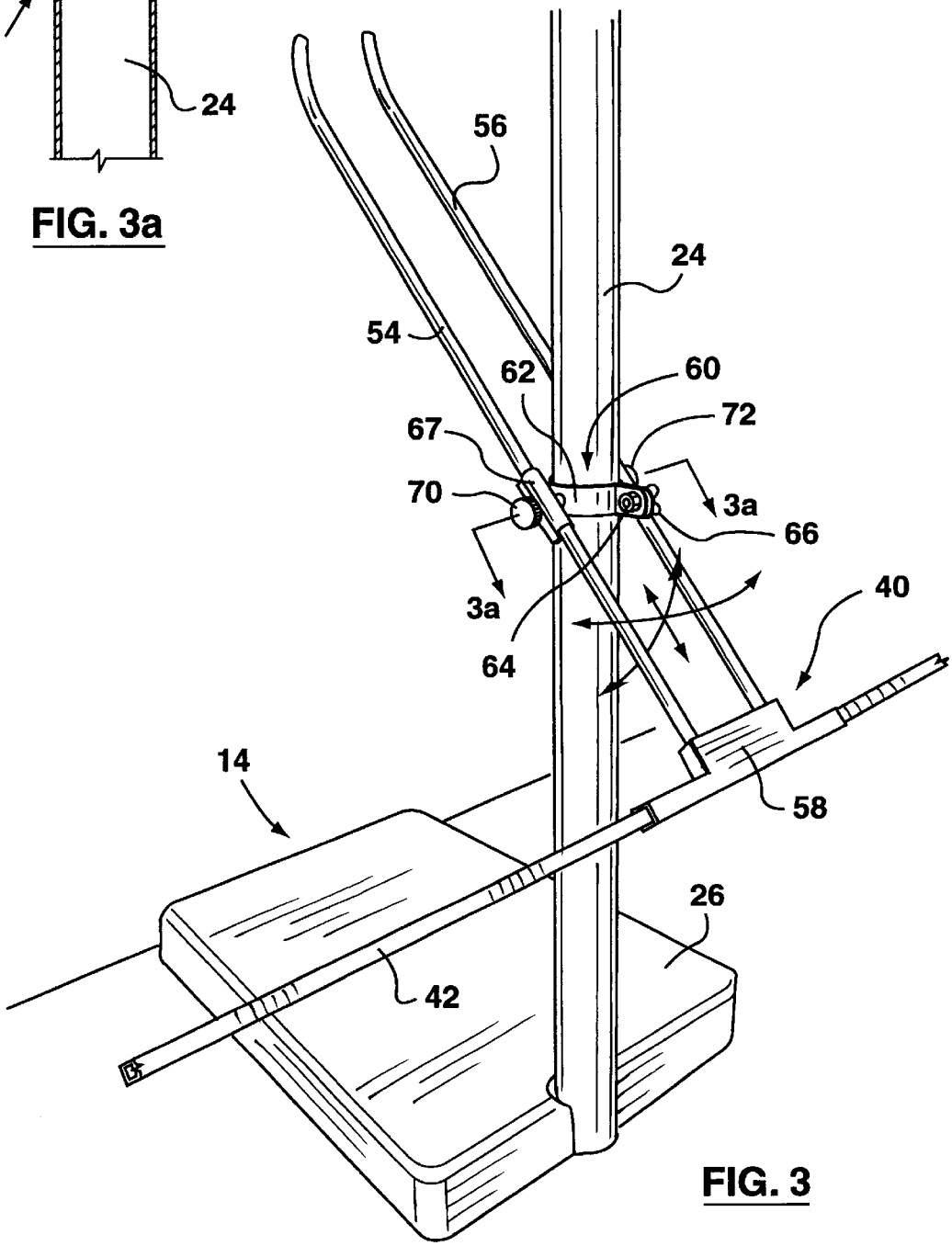
FIG. 3 is a rear perspective view on an enlarged scale showing how the attachment bracket of the net assembly is secured to the post of the hoop support.

Referring to the drawings, a basketball return net assembly 12 in accordance with one embodiment of the invention is attached to a basketball hoop support 14 which carries a basketball hoop 16. The hoop 16 is secured by a bracket 18 to a backboard 20 which is carried by a front end of a support arm 22. The rear end of the support arm 22 is mounted on the upper end portion of a post 24. The lower end of post 24 is mounted on the front end of a base 26 and stabilized by struts 28 extending from the post 24 to opposite sides of the base 26 (the struts 28 being omitted for clarity in FIG. 3). The hoop support 14 is a portable support of known kind which is frequently located on a house driveway for practice purposes.

The net assembly 12 has a flexible foldable return net 30 with an elongated bar 32 extending along the upper end of the net 30 from one end to another. The net 30 is suspended from the bracket 18 by means of a cord 34 attached to opposite ends of the bar 32 and passing over the bracket 18 just in front of the back board 20.

The net assembly 12 also includes an attachment bracket 40 having a horizontally extending frame member 42 which has a pair of positioning arms 44, 46 extending forwardly from opposite ends thereof. The frame member 42 may be telescopically extendable and contractible so as to be adaptable to different net widths. The lower corners 48, 50 of the net are secured to respective front ends of the positioning arms 44, 46 which hold the lower end of the net 30 a short distance above the ground. The space between the lower end of the net 30 and the ground is covered by a skirt 52 suspended from the lower end of the net 30.

The horizontal frame member 42 has a pair of laterally spaced mounting rods 54, 56 extending upwardly from a double T-connection 58 at the mid-width position on the frame member 42. The mounting rods 54, 56 extend past the support post 24 on opposite sides thereof, with the mounting rods 54, 56 being adjustably slidably mounted in a bracket 60 surrounding the support post 24 and vertically and angularly adjustable relative thereto.

The bracket 60 has a band member 62 surrounding the post 24 with opposite ends secured by a bolt 64 and wing nut 66. The positioning arms 54, 56 pass through clamps 67, 68 respectively secured to the band member 62 and controlled by screws 70, 72 respectively.

Figure 1:
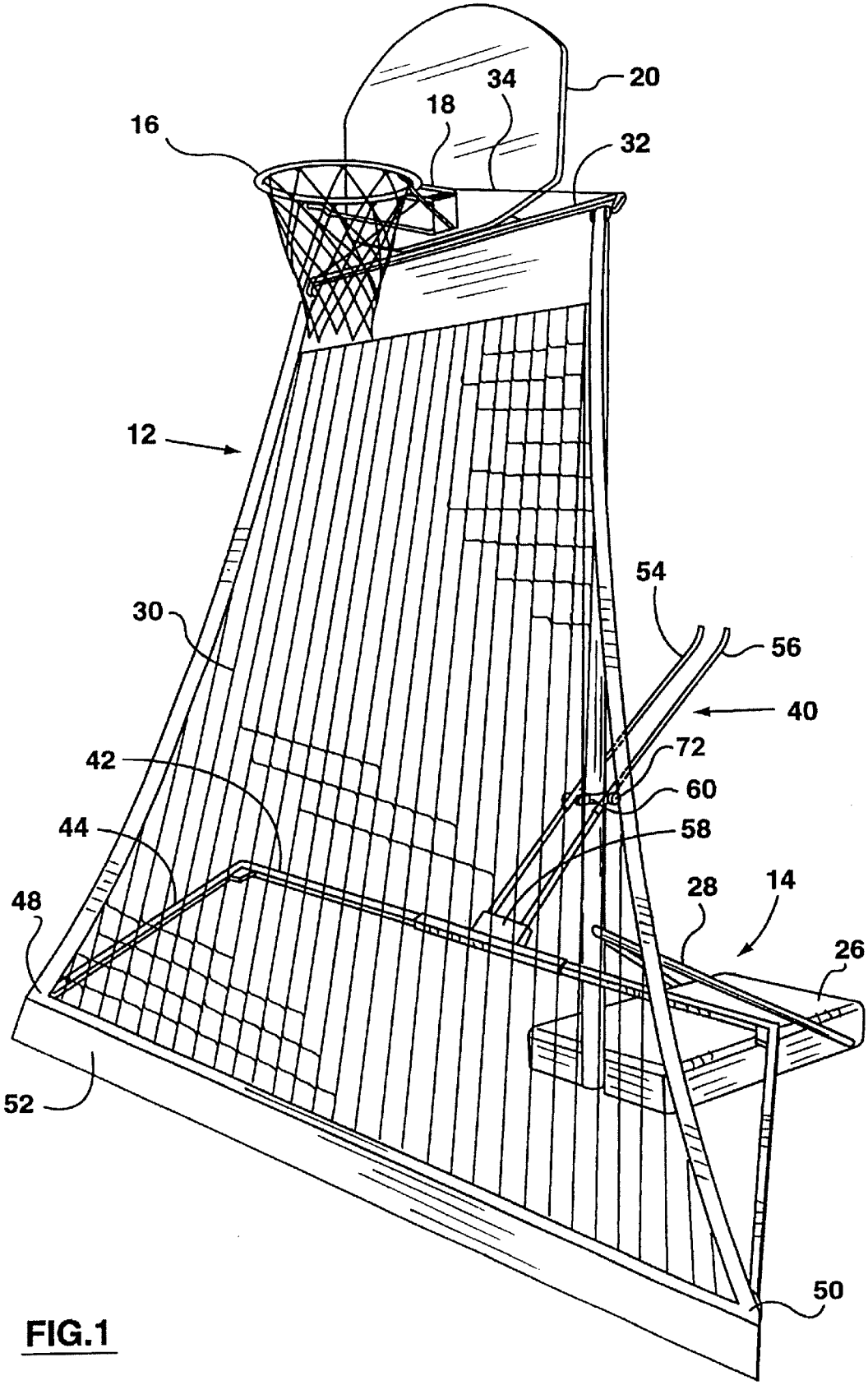
FIG. 1 is a front respective view of a net assembly in accordance with one embodiment of the invention secured to a basketball hoop support.
Figure 2:
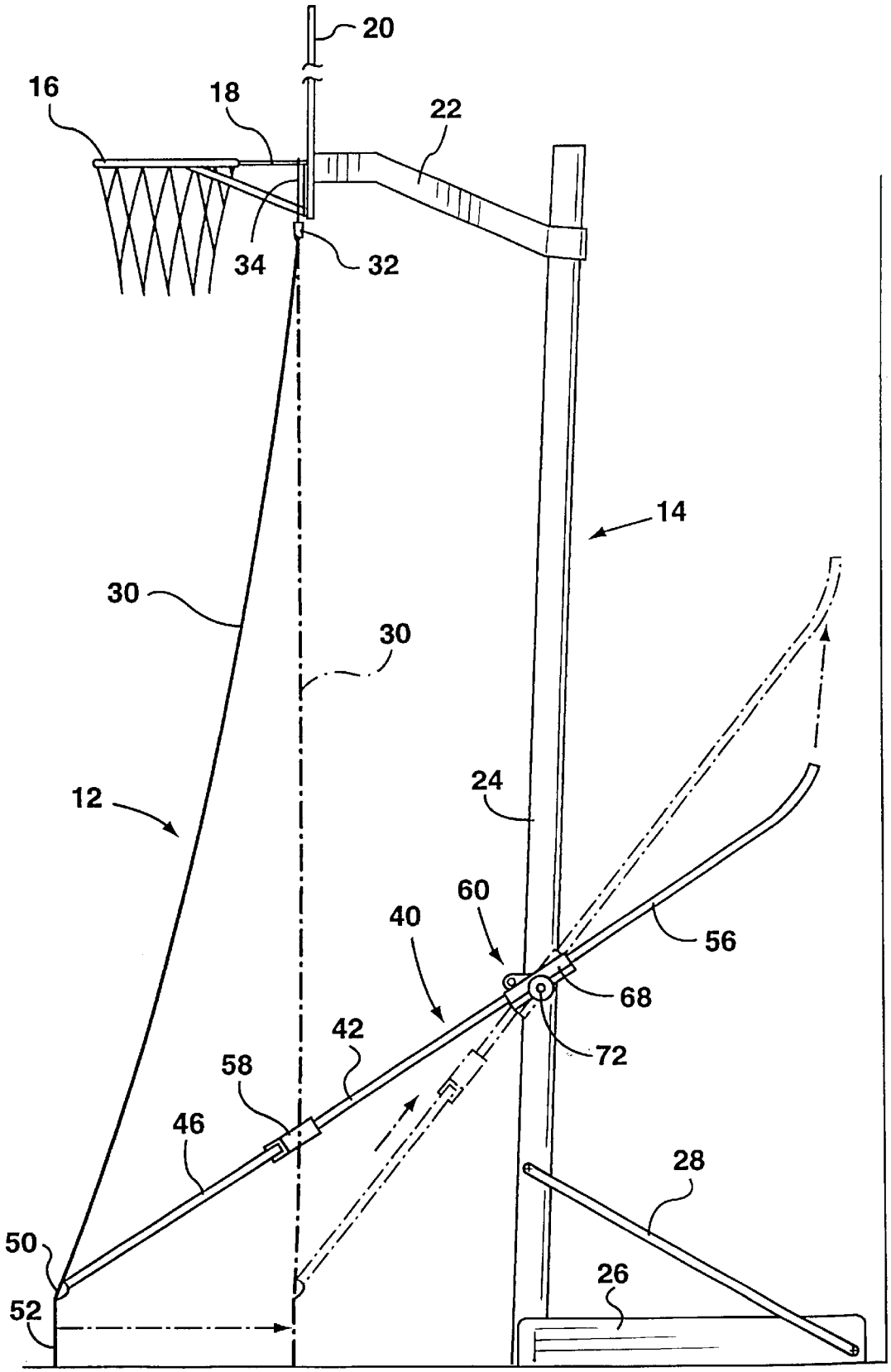
FIG. 2 is a side view of the net assembly and hoop support.
Figure 4:
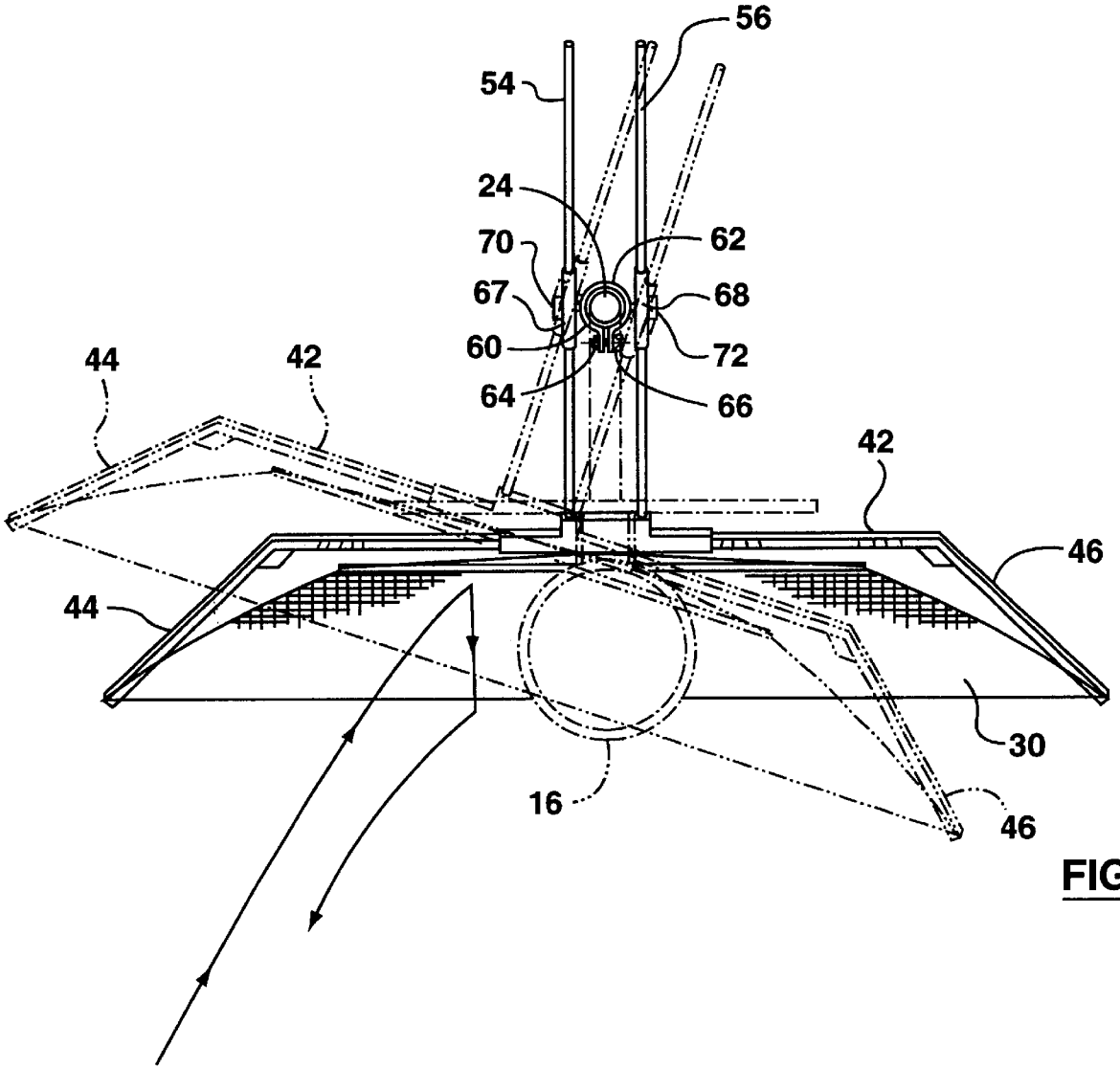
FIG. 4 is a planned view of a net assembly and hoop support post showing how the net assembly can be angled to return the shots from the side.

In use, the net assembly 12 is suspended from the bracket 18 by the cord 34, the band member 62 of the bracket 60 is passed around the support post 24 and secured by bolt 64 and wing nut 66, and the corners 48, 50 of the net 30 are secured to the front ends of the positioning arms 44, 46 in any convenient manner. As shown in FIG. 2, the net 30 can be positioned at different inclinations (including vertical) by adjustment of the positioning rods 54, 56 in the clamps 67, 68. Also, as shown in FIG. 4, the net 30 can be slewed around for practice shots from the side by loosening the bolt and wing nuts 64, 66 and swivelling the band member 62 around the support rod 24.

The advantages of the present invention will now be readily apparent to a person skilled in the art from the foregoing description of a preferred embodiment. Other embodiments will also now be readily apparent to a person skilled in the art, the scope of the invention being defined in the appended claims.

What is claimed is:

1. A basketball return net assembly attachable to a basketball hoop support having a post extending upwardly from the ground and carrying a basketball hoop adjacent an upper end thereof, the return net assembly including:

a flexible foldable return net, an elongated rigid net-carrying member extending along the upper end of the net to enable the net to be supported in a latterly-extending configuration, suspension means for suspending the upper end of the net and the net-carrying member from an upper portion of the hoop support behind the hoop, and an attachment bracket connected to opposite lower corner portions of the net and adjustably securable to the post to enable the bracket to be adjusted relative thereto, the attachment bracket has a transversely extending frame member and a pair of net positioning arms extending forwardly from respective opposite ends of the transversely extending frame member, the net having opposite lower corner portions secured to respective forward ends of the net positioning arms.

2. A return net assembly according to claim 1 wherein the attachment bracket is adjustable vertically relative to the post.

3. A return net assembly according to claim 1 wherein the attachment bracket is adjustable angularly about the longitudinal axis of the post.

4. A return net assembly according to claim 1 wherein the attachment bracket is adjustable angularly about an axis transverse to the longitudinal axis of the post.

5. A return net assembly according to claim 1 wherein the attachment bracket includes a pair of laterally spaced mounting rods extending from the transversely extending frame member past the post on opposite sides thereof and adjustably slidably mounted in a mounting bracket mounted on the post.

6. A return net assembly according to claim 5 wherein the mounting bracket is vertically and angularly adjustable relative to the post.

7. A basketball hoop support having a basketball return net assembly attached thereto, the basketball hoop support having a post extending upwardly from the ground and carrying a basketball hoop adjacent an upper end thereof, and the return net assembly including:

a flexible foldable return net, an elongated rigid net-carrying member extending along the upper end of the net to enable the net to be supported in a latterly-extending configuration, suspension means for suspending the upper end of the net and the net-carrying member from an upper portion of the hoop support behind the hoop, and an attachment bracket connected to opposite lower corner portions of the net and adjustably securable to the post to enable the bracket to be adjusted relative thereto, the attachment bracket has a transversely extending frame member and a pair of net positioning arms extending forwardly from respective opposite ends of the transversely extending frame member, the net having opposite lower corner portions secured to respective forward ends of the net positioning arms.

8. A basketball hoop support according to claim 7 wherein the adjustment bracket is adjustable vertically relative to the post.

9. A return net assembly according to claim 7 wherein the attachment bracket is adjustable angularly about the longitudinal axis of the post.

10. A return net assembly according to claim 7 wherein the attachment bracket is adjustable angularly about an axis transverse to the longitudinal axis of the post.

11. A return net assembly according to claim 7 wherein the attachment bracket includes a pair of laterally spaced mounting rods extending from the transversely extending frame member past the post on opposite sides thereof and adjustably slidably mounted in a mounting bracket mounted on the post.

12. A return net assembly according to claim 11 wherein the mounting bracket is vertically and angularly adjustable relative to the post.

* * * * *